US006863743B2

(12) United States Patent
Minevski et al.

(10) Patent No.: US 6,863,743 B2
(45) Date of Patent: Mar. 8, 2005

(54) POLYMETALATE AND HETEROPOLYMETALATE CONVERSION COATINGS FOR METAL SUBSTRATES

(75) Inventors: Zoran Minevski, The Woodlands, TX (US); Cahit Eylem, College Station, TX (US); Jason Maxey, College Station, TX (US); Carl Nelson, College Station, TX (US)

(73) Assignee: Lynntech Coatings, Ltd., College Station, TX (US)

( * ) Notice: Subject to any disclaimer, the term of this patent is extended or adjusted under 35 U.S.C. 154(b) by 156 days.

(21) Appl. No.: 10/331,963

(22) Filed: Dec. 30, 2002

(65) Prior Publication Data

US 2003/0121569 A1 Jul. 3, 2003

Related U.S. Application Data

(62) Division of application No. 09/464,284, filed on Dec. 15, 1999, now Pat. No. 6,500,276.
(60) Provisional application No. 60/112,287, filed on Dec. 15, 1998.

(51) Int. Cl.[7] ..... C23C 22/60
(52) U.S. Cl. ..... 148/261; 148/262; 148/273
(58) Field of Search ..... 148/261, 262, 148/279, 284, 285

(56) References Cited

U.S. PATENT DOCUMENTS 3,009,842 A 11/1961 Steinbrecher et al.
3,365,313 A 1/1968 Roberts, Jr. et al.
3,726,721 A 4/1973 Wittrock et al.
3,895,971 A 7/1975 Bushey et al.
3,960,676 A 6/1976 Miyosawa et al.
3,962,061 A * 6/1976 Nikaido et al. ..... 205/704
3,994,392 A 11/1976 Kajiyama et al.

(List continued on next page.)

FOREIGN PATENT DOCUMENTS

DE 3407095 A1 8/1985
EP 403241 6/1990
EP 760401 A1 3/1997
EP 724643 B1 11/1998
WO WO 95/14117 5/1995
WO WO 00/36176 6/2000

OTHER PUBLICATIONS

K. Bouzek, I Rousar, M.A. Taylor, Influence of anode material on current yields during ferrate (vi) production by anodic iron dissolution Part I: Current efficiency during anodic dissolution of grey cast iron to ferrate (vi) in concentrated alkali hydroxide solutions, revised Nov. 28, 1995 pp. 919 to 923.

(List continued on next page.)

*Primary Examiner*—George Wyszomierski
(74) *Attorney, Agent, or Firm*—Streets & Steele; Jeffrey Streets; Frank J. Campigotto

(57) ABSTRACT

The present invention provides a conversion coating solution containing polymetalates and/or heteropolymetalates to oxidize the surface of various metal substrates. The polymetalates have the general formula $M_xO_y^{n-}$, where M is selected from the group comprising Mo, V and W. The heteropolymetalates have the general formula $BM_xO_y^{n-}$, where B is a heteroatom selected from P, Si, Ce, Mn or Co, and M is again selected from Mo, V, W or combinations thereof. The concentration of polymetalates and/or heteropolymetalates anions is preferably between about 1% and about 5% by weight. Examples of typical anions used include, but are not limited to, $(PMo_{12}O_{40})^{3-}$, $(PMo_{10}V_2O_{40})^{5-}$, $(MnPW_{11}O_{39})^{5-}$, $(PW_{12}O_{40})^{3-}$, $(SiMo_{12}O_{40})^{4-}$, $(SiW_{12}O_{40})^{4-}$, $(Mo_7O_{24})^{6-}$, $(CeMo_{12}O_{42})^{8-}$ and mixtures thereof.

59 Claims, 3 Drawing Sheets

| Corresponding Example | Boehmite | Conversion Solution | | | Post-Sealants | | Corrosion Performance |
|---|---|---|---|---|---|---|---|
| | | Heteropoly-molybdate (2 wt%) | Additives (wt%) | Temp (°C) | $Ca(OH)_2$ | Silicate | Salt Fog Results (days) |
| 1 | YES | no conversion step | | | NO | NO | 1 |
| 2 | YES | $H_3PMo_{12}O_{40}$ | NONE | 80 | NO | NO | 3 |
| 3 | YES | $H_3PMo_{12}O_{40}$ | 0.5% $Na_2SiF_6$ 1% $KMNO_4$ | 80 | NO | NO | 4 |
| 5 | YES | $H_3PMo_{12}O_{40}$ | NONE | 25 | YES | YES | 7 |
| 5 | YES | $H_3PMo_{12}O_{40}$ | NONE | 60 | YES | YES | 10 |
| 5 | YES | $H_3PMo_{12}O_{40}$ | NONE | 80 | YES | YES | 20 |
| 6 | YES | $H_3PMo_{12}O_{40}$ | 0.5% $Na_2SiF_6$ | 25 | YES | YES | 13 |
| 6 | YES | $H_3PMo_{12}O_{40}$ | 0.5% $Na_2SiF_6$ 1% $KMNO_4$ | 25 | YES | YES | 18 |
| 6 | YES | $H_3PMo_{12}O_{40}$ | 0.5% $Na_2SiF_6$ | 60 | YES | YES | 17 |
| 6 | YES | $H_3PMo_{12}O_{40}$ | 0.5%$Na_2SiF_6$ 1% $KMNO_4$ | 60 | YES | YES | 14 |
| 6 | YES | $H_3PMo_{12}O_{40}$ | 0.5% $Na_2SiF_6$ | 80 | YES | YES | 18 |
| 6 | YES | $H_3PMo_{12}O_{40}$ | 0.5% $Na_2SiF_6$ 1% $KMNO_4$ | 80 | YES | YES | 4 |
| 2 | YES | $Na_4SiMo_{12}O_{40}$ | NONE | 80 | NO | NO | 3 |
| 5 | YES | $Na_4SiMo_{12}O_{40}$ | NONE | 25 | YES | YES | 8 |
| 5 | YES | $Na_4SiMo_{12}O_{40}$ | NONE | 60 | YES | YES | 10 |
| 5 | YES | $Na_4SiMo_{12}O_{40}$ | NONE | 80 | YES | YES | 20 |
| 2 | YES | $H_4SiMo_{12}O_{40}$ | NONE | 80 | NO | NO | 2 |
| 5 | YES | $H_4SiMo_{12}O_{40}$ | NONE | 25 | YES | YES | 13 |
| 5 | YES | $H_4SiMo_{12}O_{40}$ | NONE | 60 | YES | YES | 19 |
| 5 | YES | $H_4SiMo_{12}O_{40}$ | NONE | 80 | YES | YES | 20 |

U.S. PATENT DOCUMENTS

| | | | | | |
|---|---|---|---|---|---|
| 4,435,256 | A | | 3/1984 | Deininger | |
| 4,435,257 | A | | 3/1984 | Deininger | |
| 4,451,338 | A | | 5/1984 | Deininger | |
| 4,606,843 | A | | 8/1986 | Kaezur | |
| 4,755,224 | A | | 7/1988 | Bibber | |
| 4,765,870 | A | * | 8/1988 | Emmer et al. | 148/254 |
| 4,828,615 | A | | 5/1989 | Cape | |
| 4,878,963 | A | | 11/1989 | Bibber | |
| 4,895,608 | A | | 1/1990 | Bibber | |
| 4,988,396 | A | | 1/1991 | Bibber | |
| 5,192,374 | A | | 3/1993 | Kindler | |
| 5,217,584 | A | | 6/1993 | Deininger | |
| 5,356,492 | A | | 10/1994 | Miller | |
| 5,399,210 | A | | 3/1995 | Miller | |
| 5,419,790 | A | | 5/1995 | Miller | |
| 5,437,740 | A | | 8/1995 | Bibber | |
| 5,449,415 | A | | 9/1995 | Dolan | |
| 5,520,750 | A | * | 5/1996 | Riley | 148/261 |
| 5,554,231 | A | | 9/1996 | Bibber | |
| 5,607,521 | A | | 3/1997 | Bech-Nielsen et al. | |
| 5,637,143 | A | | 6/1997 | Jenkins et al. | |
| 5,683,816 | A | | 11/1997 | Goodreau | |
| 5,707,465 | A | | 1/1998 | Bibber | |
| 5,746,994 | A | | 5/1998 | Johnson | |
| 5,879,816 | A | * | 3/1999 | Mori et al. | 428/621 |
| 6,017,491 | A | | 1/2000 | Sharaby et al. | |
| 6,022,425 | A | * | 2/2000 | Nelson et al. | 148/272 |
| 6,206,982 | B1 | * | 3/2001 | Hughes et al. | 148/273 |

OTHER PUBLICATIONS

K. Bouzek, I Rousar, M.A. Taylor, Influence of anode material on current yields during ferrate (vi) production by anodic iron dissolution Part II, Current efficiency during anodic dissolution white cast iron to ferrate (iv) in concentrated alkali hydroxide solutions, revised Jan. 11, 1996 pp. 925–931.

K. Bouzek, I Rousar, Current efficiency during anodic dissolution of iron to ferrate (vi) in concentrated alkali hydroxide solutions revised Apr. 23, 1993 pp. 1317–1322.

A. Denvir, D. Pletcher, Electrochemical generation of ferrate Part I: Dissolution of an iron wool bed anode, revised Oct. 31, 1995 pp. 815–821.

A. Denvir, D. Pletcher, Electrochemical generation of ferrate Part 2: Influence of anode composition revised Oct. 31, 1995 pp. 823–827.

Lionel Delaude and Pierre Laszlo, A Novel Oxidizing Reagent Based on Potassium Ferrate (VI) Apr. 5, 1996 pp. 6360–6370.

Henry J. Hrostowski and Allen B. Scott, The Magnetic Susceptibility of Potassium Ferrate, Jun. 10, 1949, pp. 105–107.

G.W. Thompson, L.T. Ockerman and J.M. Schreyer, Preparation and Purification of Potassium Ferrate VI, Aug. 9, 1950, pp. 1379–1381.

* cited by examiner

| Corresponding Example | Boehmite | Conversion Solution | | | Post-Sealants | | Corrosion Performance |
|---|---|---|---|---|---|---|---|
| | | Heteropoly-molybdate (2 wt%) | Additives (wt%) | Temp (°C) | $Ca(OH)_2$ | Silicate | Salt Fog Results (days) |
| 1 | YES | no conversion step | | | NO | NO | 1 |
| 2 | YES | $H_3PMo_{12}O_{40}$ | NONE | 80 | NO | NO | 3 |
| 3 | YES | $H_3PMo_{12}O_{40}$ | 0.5% $Na_2SiF_6$ 1% $KMNO_4$ | 80 | NO | NO | 4 |
| 5 | YES | $H_3PMo_{12}O_{40}$ | NONE | 25 | YES | YES | 7 |
| 5 | YES | $H_3PMo_{12}O_{40}$ | NONE | 60 | YES | YES | 10 |
| 5 | YES | $H_3PMo_{12}O_{40}$ | NONE | 80 | YES | YES | 20 |
| 6 | YES | $H_3PMo_{12}O_{40}$ | 0.5% $Na_2SiF_6$ | 25 | YES | YES | 13 |
| 6 | YES | $H_3PMo_{12}O_{40}$ | 0.5% $Na_2SiF_6$ 1% $KMNO_4$ | 25 | YES | YES | 18 |
| 6 | YES | $H_3PMo_{12}O_{40}$ | 0.5% $Na_2SiF_6$ | 60 | YES | YES | 17 |
| 6 | YES | $H_3PMo_{12}O_{40}$ | 0.5%$Na_2SiF_6$ 1% $KMNO_4$ | 60 | YES | YES | 14 |
| 6 | YES | $H_3PMo_{12}O_{40}$ | 0.5% $Na_2SiF_6$ | 80 | YES | YES | 18 |
| 6 | YES | $H_3PMo_{12}O_{40}$ | 0.5% $Na_2SiF_6$ 1% $KMNO_4$ | 80 | YES | YES | 4 |
| 2 | YES | $Na_4SiMo_{12}O_{40}$ | NONE | 80 | NO | NO | 3 |
| 5 | YES | $Na_4SiMo_{12}O_{40}$ | NONE | 25 | YES | YES | 8 |
| 5 | YES | $Na_4SiMo_{12}O_{40}$ | NONE | 60 | YES | YES | 10 |
| 5 | YES | $Na_4SiMo_{12}O_{40}$ | NONE | 80 | YES | YES | 20 |
| 2 | YES | $H_4SiMo_{12}O_{40}$ | NONE | 80 | NO | NO | 2 |
| 5 | YES | $H_4SiMo_{12}O_{40}$ | NONE | 25 | YES | YES | 13 |
| 5 | YES | $H_4SiMo_{12}O_{40}$ | NONE | 60 | YES | YES | 19 |
| 5 | YES | $H_4SiMo_{12}O_{40}$ | NONE | 80 | YES | YES | 20 |

Figure 4

POLYMETALATE AND HETEROPOLYMETALATE CONVERSION COATINGS FOR METAL SUBSTRATES

This is a divisional application of U.S. patent application Ser. No. 09/464,284, filed Dec. 15, 1999 U.S. Pat. No. 6,500,276, which claimed priority to U.S. Provisional Patent Application No. 60/112,287 filed Dec. 15, 1998.

BACKGROUND OF THE INVENTION

1. Field of the Invention

The present invention relates to a method for forming conversion coatings on metal substrates, such as aluminum or aluminum alloys.

2. Background of the Related Art

Chemical conversion coatings are generally formed by causing the surface of the metal to be "converted" into a tightly adherent coating, all or part of which consists of an oxidized form of the substrate metal. Chemical conversion coatings often provide good corrosion resistance and strong bonding affinity for coatings such as paint. The industrial application of paint to metals generally requires the use of a chemical conversion coating, particularly when the service conditions impose high performance demands.

Although aluminum and aluminum alloys typically offer good corrosion resistance due to the formation of a natural oxide coating at the surface, the protection is limited. Aluminum alloys exposed to a combination of moisture and electrolytes corrode much more rapidly than pure aluminum, especially where such aluminum alloys may contain copper.

There are generally two types of processes for forming corrosion resistant conversion coatings on metal substrates, such as aluminum or aluminum alloy substrates. The first process involves anodic oxidation (anodization) where the substrate is immersed in a chemical bath, such as a chromic or sulfuric acid bath, and an electric current is passed through the substrate and the chemical bath. The conversion coating thus formed on the surface of the substrate provides improved corrosion resistance and an improved bonding surface for organic coatings and finishes.

The second process for forming a corrosion resistant chemical conversion coating produces a chemical conversion coating by subjecting the substrate to a chemical solution, such as a chromic acid solution, but without using an electric current in the process. The chemical solution may be applied through immersion of the substrate, manual application or spray application. The resulting conversion coating on the surface of the aluminum or aluminum alloy substrate provides improved resistance to corrosion and an improved bonding surface for organic coatings and finishes.

Chromate based conversion coatings have been widely used in applications where maximum corrosion protection is needed. For example, treating aluminum or aluminum alloy substrates with a chromate conversion coating bath generally results in a favorably thick, corrosion resistant film consisting of hydrated Cr (III) and Al (III) oxides. This reaction is driven by the reduction of high-valent Cr (VI) ions and the oxidation of the Al metal. The benefits of this chromate conversion coating include hydrophobicity and self-healing properties.

The light weight and high strength of aluminum and aluminum alloys make these materials particularly useful in aviation and aerospace applications. Many aluminum structural parts, including Cd-plated aluminum, Zn-plated aluminum and Zn—Ni plated aluminum, are currently being treated using chromic acid process technology. Chromic acid conversion films, as formed on aluminum and aluminum alloy substrates, meet the ASTM Method B-117 168-hour salt fog exposure corrosion resistance criterion, but they primarily serve as a substrate surface for coatings or paint adhesion. Chromic acid conversion coatings are relatively thin and low in weight coatings (40–150 milligrams per square foot), and do not cause unfavorable reductions in the fatigue life of the aluminum and aluminum alloy structures to which they are applied.

The use of chromate conversion coatings for aluminum and aluminum alloy substrates, as well as other substrates, are not without drawbacks. Researchers have increasingly found problems with chromate conversion coatings related to their extreme toxicity and carcinogenocity. Researchers have linked exposure to chromates to a variety of human illnesses including irritation of the respiratory tract, ulcerations and perforations of the nasal septum, dermatitis, skin sensitization, asthma and lung cancer. As a result of these findings, federal and state environmental regulations have been promulgated, particularly in California, as well as in other countries, that impose drastic restrictions on the allowable levels of hexavalent chromium (Cr (IV)) compounds in effluents and emissions related to metal finishing processes. Consequently, chemical conversion processes employing hexavalent chromium compounds have become prohibitively expensive, if permissible at all, and this has given rise to the need for an alternative means of achieving comparable material properties without the use of chromates.

Recent efforts to produce non-chromate conversion coatings have involved the use of other oxidizing agents including cerium compounds, alkaline solutions of lithium salts, and manganates and molybdates. Investigators have studied the effects of cerium compounds as a corrosion inhibitor for aluminum and copper alloys such as Al 2024-T3 in chloride-containing solutions. It was proposed that cerium inhibits corrosion of this alloy by reducing the rate of cathodic reduction of oxygen due to formation of cerium (III)-rich films over copper containing intermetallics that act as local cathodic sites.

A process for surface modification of aluminum-based materials that involves immersion in boiling cerium salts followed by anodic polarization in a molybdate solution has been reported. Although this surface modification process produced good corrosion resistant films, the long-term boiling of the substrate presented problems of pre-treating large structures. The problems of long-term boiling along with those of the electrochemical post-treatment step made this process unattractive for practical applications.

An unusual passivity of aluminum alloys has been found when the aluminum alloys are exposed to alkaline solutions of lithium salts. The observed passivity has been explained as a consequence of the formation of a polycrystalline $Li_2[Al_2(OH)_6]_2CO_3.3H_2O$ film on the aluminum alloy surface. This film, referred to as hydrotalcite or "talc" coating, has been reported to offer increased corrosion protection during exposure to aggressive environments. The best results, however, were obtained when the coated samples were allowed to cure for at least one week before any corrosion test was made. This extremely long cure time would undoubtedly cause problems in practical industrial applications of talc coatings. Although talc coatings improve the corrosion resistance of various substrates, only alloys with low concentrations of alloying elements (Al 6061-T6 and Al 1100) passed the ASTM Method B-117 salt fog test.

Attention has also been directed towards the use of manganates and molybdates in conversion coating solutions for aluminum alloys. The permanganate conversion coating solutions included salts, such as silicates, borates, nitrates, halides and phosphates.

Isomolybdates were shown to improve the corrosion resistance of aluminum and aluminum alloys against localized attack by shifting the breakdown potential ($E_b$) in a positive direction. The following reactions are believed to be involved in the formation of a molybdenum-based conversion coating on aluminum:

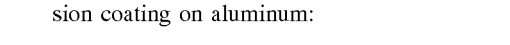

$$MoO_4^{2-}+5H^++Al=Mo^{3+}+\tfrac{1}{2}Al_2O_3.3H_2O+H_2O$$

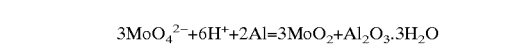

$$3MoO_4^{2-}+6H^++2Al=3MoO_2+Al_2O_3.3H_2O$$

The treatment converts the aluminum surface to a superficial layer containing a complex mixture of aluminum/molybdenum compounds. It has been shown that the hydrated $Mo^{4+}$ concentration in the film at all potentials was approximately 2 to 3 times greater than the concentration of the hexavalent $Mo^{6+}$. It has been suggested that the corrosion resistance of these molybdate coatings was due to the molybdate (VI)-rich regions on the film surface that inhibited the ingress of $Cl^-$ anions to the metal/film interface. In the presence of alkaline solutions, however, molybdenum has a slight tendency to decompose water with the evolution of hydrogen, dissolving the molybdate in the hexavalent state as the molybdate ion, $MoO_4^{2-}$, thus weakening the conversion coating on the metal surface. Thus, to prepare a suitable hexavalent molybdate ($Mo^{6+}$) conversion solution, it will be necessary to operate in an alkaline condition with a pH greater than 10. In molybdate-free solutions at pH 10, AlOOH that would naturally form under lower pH conditions is not suitable and will tend to dissolve. The presence of molybdates in the solutions is not sufficient to limit the rapid dissolution of the Al and, hence, formation of a conversion coating based on isomolybdates under these conditions is unfavorable.

Therefore, there is a need for a conversion coating solution containing non-toxic ions that form a stable corrosion resistant conversion coating on metal surfaces, particularly on aluminum and aluminum alloys. It is desirable that the conversion coating solution be suitable for sound adherence of an applied protective coating, such as paint. There is also a need for a method for using a conversion coating solution containing non-toxic ions to form a stable corrosion resistant conversion coating on metal surfaces, particularly on aluminum and aluminum alloys.

SUMMARY OF THE INVENTION

The present invention provides a conversion coating solution containing polymetalates and/or heteropolymetalates to oxidize the surface of various metal substrates. The polymetalates have the general formula $M_xO_y^{n-}$, where M is selected from the group comprising Mo, V and W. The heteropolymetalates have the general formula $BM_xO_y^{n-}$, where B is a heteroatom selected from P, Si, Ce, Mn or Co, and M is again selected from Mo, V, W or combinations thereof. The concentration of polymetalates and/or heteropolymetalates anions is preferably between about 1% and about 5% by weight. Examples of typical anions used include, but are not limited to, $(PMo_{12}O_{40})^{3-}$, $(PMo_{10}V_2O_{40})^{5-}$, $(MnPW_{11}O_{39})^{5-}$, $(PW_{12}O_{40})^{3-}$, $(SiMo_{12}O_{40})^{4-}$, $(SiW_{12}O_{40})^{4-}$, $(Mo_7O_{24})^{6-}$, $(CeMo_{12}O_{42})^{8-}$ and mixtures thereof. The present invention also provides a method of using the solution to provide corrosion resistance and adherence of external coatings to the treated metal substrate.

BRIEF DESCRIPTION OF THE DRAWINGS

So that the above recited features and advantages of the present invention can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

FIG. 4 is a table showing the solutions and conditions utilized to prepare conversion coatings on a large number of Al-2024 panels and the salt fog survival of those coated panels.

DETAILED DESCRIPTION OF THE INVENTION

Figure 1:
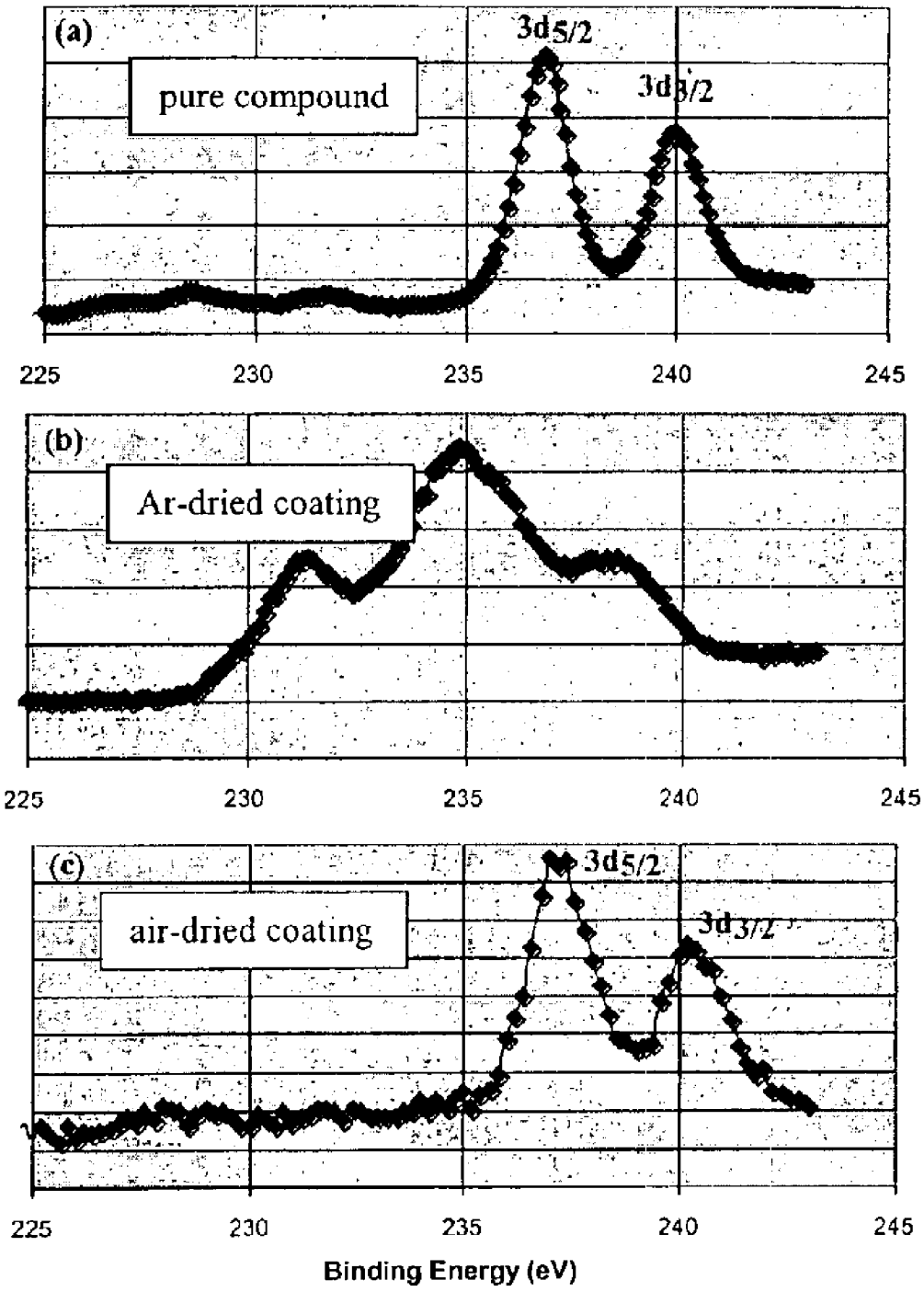
FIG. 1 provides graphs of Mo3d XPS spectra of (a) $H_3PMo_{12}O_{40}.xH_2O$; (b) an argon dried Al-2024 panel that was treated with conversion coating solution containing $H_3PMo_{12}O_{40}$ and $Na_2SiF_6$; and (c) an air dried Al-2024 panel that was treated with conversion coating solution containing $H_3PMo_{12}O_{40}$ and $Na_2SiF_6$.
Figure 2:
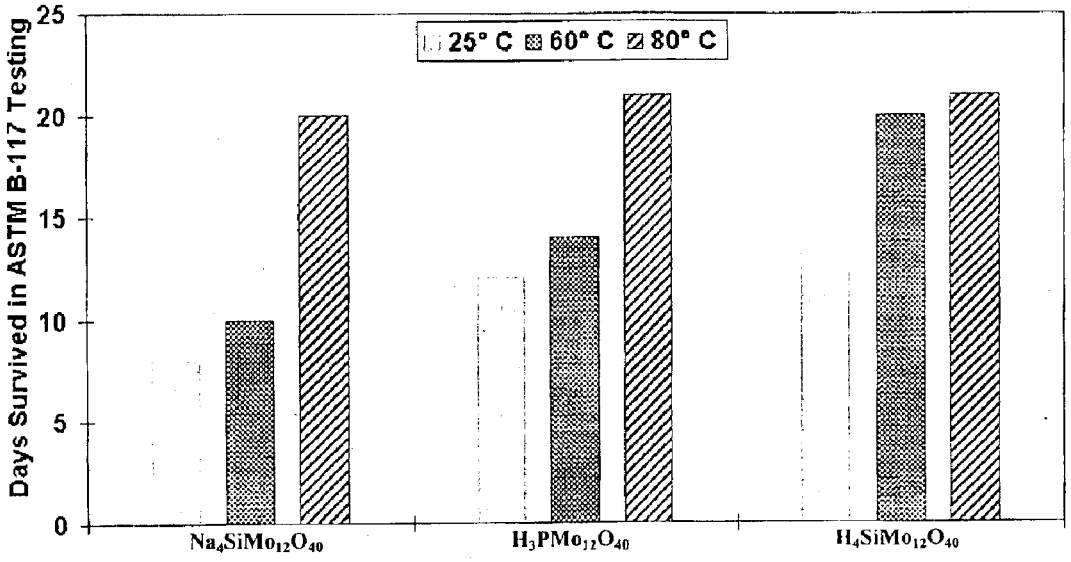
FIG. 2 is a graph showing the effect of heteropolyoxylate source and temperature on salt fog survival of aluminum 2024-T3 treated as described in Example 5.
Figure 3:
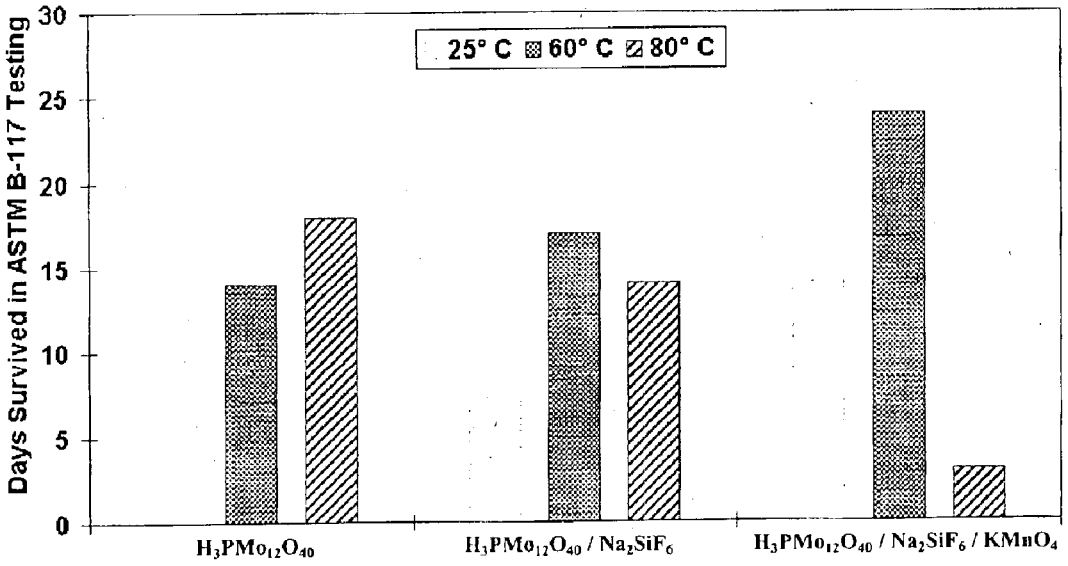
FIG. 3 is a graph showing the effect of additives and temperature on salt fog survival of aluminum 2024-T3 treated as described in Example 6.

The present invention relates to chromate-free conversion coating solutions for metal substrates selected from aluminum, aluminum alloys, steels (e.g., carbon steels and stainless steels), and other ferrous metals. Where the terms "aluminum" and "aluminum alloys" are used herein, they should be interpreted to be inclusive of each other, i.e. "aluminum" does not exclude aluminum alloys, unless the description specifically states otherwise.

Non-toxic polymetalates and heteropolymetalates are inorganic, non-toxic metal-oxygen clusters that contain large reservoirs of transition metals, such as $Mo_x^{6+}$, $W_x^{6+}$ and $V_x^{5+}$ (x>1). In their highest oxidation states, these compounds closely mimic chromates in forming active, self-healing coatings. These compounds accept electrons without major changes of their structures, are highly soluble in various solvents, exhibit good adsorption on solid surfaces, and are very strong oxidants. In addition, the reduced form of these compounds can be oxidized in air, thus providing continuously regenerated reservoirs of high-valent metal states on the metal surface that introduce the beneficial "self-healing" action attributable to favorable chemical conversion coatings. By contrast, hexavalent isomolybdates, $MoO_4^{2-}$ for example, are stable only in very basic solutions where the dissolution of aluminum is a major problem. Another attractive feature of the heteropolymetalate compounds is that they readily accommodate heteroatoms such as Ce, Si, P and Mn that are known to be beneficial for forming a conversion coating.

One aspect of the present invention provides a conversion coating solution containing polymetalates and/or heteropolymetalates to oxidize the surface of various metal substrates. The polymetalates have the general formula $M_xO_y^{n-}$, where M is selected from the group comprising Mo, V and W. The heteropolymetalates have the general formula $BM_xO_y^{n-}$, where B is a heteroatom selected from P, Si, Ce, Mn or Co, and M is again selected from Mo, V, W or combinations thereof. The concentration of polymetalates and/or heteropolymetalates anions is preferably between about 1% and about 5% by weight. Examples of typical anions used include, but are not limited to, $(PMo_{12}O_{40})^{3-}$, $(PMo_{10}V_2O_{40})^{5-}$, $(MnPW_{11}O_{39})^{5-}$, $(PW_{12}O_{40})^{3-}$, $(SiMo_{12}O_{40})^{4-}$, $(SiW_{12}O_{40})^{4-}$, $(Mo_7O_{24})^{6-}$, $(CeMo_{12}O_{42})^{8-}$ and mixtures thereof.

Another aspect of the present invention relates to a method for forming an oxide or hydrous oxide conversion coating on a metal surface. The metal surface is contacted with an aqueous conversion coating solution containing polymetalates and/or heteropolymetalates. These conversion coating solutions preferably contain between about 1% and about 5% polymetalate or heteropolymetalate anions, and preferably have a pH of between about 2 to about 5. These solutions produce chemical conversion coatings that are effective in protecting metal substrates subjected to the standard ASTM method B-117 salt fog test.

The chemical conversion coating solutions used in the present invention may also contain fluoride ions. Fluoride ions are beneficial to the conversion coating because they aid in building thickness of the coating on the metal surface. These fluoride ions can be obtained from a number of sources such as ammonium metal fluorides, alkali metal fluorides, fluorosilicic salts, fluorotitanic salts and fluorozirconic salts. The concentration of fluoride ions in solution is preferably between about 0.1% and about 3.0% by weight.

The conversion coating solution may also contain additional transition metal oxides with high-valent transition metal cations such as $Mn^{7+}$, $V^{5+}$, $Re^{7+}$. The transition metal oxides may be obtained from sources such as alkali metal permanganate, perrhenate, and metavanadate. The concentration of transition metal oxides in the solution is preferably between about 0.1% and about 3.0% by weight. Pentavalent vanadium species are known to form polyvanadate anions such as $HV_{10}O_{28}{}^{4-}$ in acidic solutions. Polyvanadate anions have been utilized for sealing conversion coated metal surfaces.

The addition of ionic compounds to the aqueous chemical conversion coating solution in appropriate concentrations may benefit the performance of the resulting conversion coating. The particular additives for improved performance depend on the chemical composition of the substrate, the chemical composition of the aqueous solution and the anticipated service conditions. The concentrations of each particular additive may depend on these same parameters as well as the concentrations of other additives in the solution.

The aqueous chemical conversion coating solution of the present invention may also contain silicate ions at concentrations of between about 0.1% and about 3.0% by weight. The silicate ions may be obtained from water-soluble alkali metal silicate salts.

The aqueous chemical conversion coating solution of the present invention may also contain borate ions at concentrations of between about 0.1% and about 3.0% by weight. The borate ions can be obtained from water-soluble alkali metal salts, for example, alkali metal tetraborate.

The aqueous chemical conversion coating solution of the present invention may also contain phosphate ions at concentrations between about 0.1% and about 3.0% by weight. The phosphate ions may be obtained from water-soluble alkali metal phosphate salts including, but not limited to, alkali metal orthophosphate, alkali metal metaphosphate, alkali metal pyrophosphate and mixtures thereof.

The aqueous chemical conversion coating solution of the present invention may also contain nitrate ions in concentrations of between 0.1% and about 3% by weight. The nitrate ions may be obtained from alkali metals or ammonium nitrates.

The amounts of the various ions discussed above may be determined theoretically before preparation of the aqueous conversion coating solution or they may be measured analytically using techniques know to one skilled in the art and adjusted accordingly.

Preferably, the surface of the substrate is properly cleaned and pre-treated before contacting with the aqueous chemical conversion coating solution. The substrate surface can be cleaned by sonicating in acetone or by any of several commercially available alkaline cleaning solutions to remove dirt, grease or other contaminants, followed by a water rinse and treatment with any of several commercially available deoxidizing solutions such as LNC deoxidizer (Oakite Products Inc., Berkeley Heights, N.J.) to remove any residual oxide surface coating. If the substrate is aluminum, the cleaned surface may then be rinsed or soaked in boiling water or anodized to form a boehmite layer of the general formula $(AlO_x(OH)_y)$ prior to immersion in the aqueous chemical conversion coating solution.

The properties of the chemical conversion coating achieved using the present invention also depend on the contact time of the conversion solution with the substrate, the temperature of the conversion solution and the substrate, and the pH of the conversion solution. The contact time will typically range from about 1 minute to about 5 minutes. The temperature of the conversion solution will typically range from about 25° C. to about 80° C. The pH of the conversion solution is typically between about 2 to about 5, depending on the composition of the conversion solution.

After the polymetalate or heteropolymetalate conversion coating is applied, post treatment steps may be used to seal the conversion coating onto the surface of the substrate and to thereby improve the overall performance of the chemical conversion coating. Post-treatment of the applied chemical conversion coating may include contacting the oxidized substrate surface with a post-treatment aqueous solution containing one or more compounds selected from the group comprising an alkali metal silicate, an alkali metal borate, an alkali metal phosphate, magnesium hydroxide, calcium hydroxide, barium hydroxide and combinations thereof. Preferably, the concentration of these compounds in the post-treatment solution is between about 0.015% and about 10% by weight. The contact time during which the treated substrate is immersed in the post-treatment solution is preferably between about 1 minute and about 20 minutes. The temperature of the post-treatment solution and the substrate during the post-treatment step is preferably between about ambient or room temperature (typically about 25° C.) and about the boiling point of the aqueous solution (typically about 100° C.).

The post-treatment step, for example using calcium hydroxide, is performed by reducing the concentration of carbon dioxide in water, forming a solution by combining calcium hydroxide with the water having a reduced concentration of carbon dioxide, and providing contact between the metal surface and the solution. The concentration of carbon dioxide in water may be reduced through any known process, but is preferably reduced by heating the water, most preferably to a temperature between 50° C. and 100° C. Other processes for reducing the carbon dioxide concentration in water include passing the water through an electroosmotic pump, passing the carbon dioxide through a hydrophobic membrane or centrifuging the water. It is important that the carbon dioxide content of the water be reduced, since the amount of carbon dioxide present in water at room temperature will yield a solution that does not produce the desired conversion coating.

Aluminum panels prepared with heteropolymetalate conversion coatings are immersed in one or more post-treatment solutions, such as alkali metal silicate and calcium hydroxide, between 80° C. to 100° C. for 1 minute to 20 minutes. Preferably, the treated aluminum panels then received post-treatment by being immersed, first in an aqueous solution containing 0.09% by weight calcium hydroxide and 0.6% by weight lithium nitrate at 100° C. for 20 minutes, and second in an aqueous solution containing 2.4% by weight alkali metal silicate at 80° C. for 5 minutes. Optionally, the aqueous calcium hydroxide solution may further include manganese, molybdenum or a combination thereof that form stable metal oxides in the coatings and act as inhibitors to corrosion of the coatings.

The following examples of usage of the present invention show the function of the invention and disclose some of its preferred embodiments. These examples are not to be taken as limiting the scope of the invention to the steps described therein, as the invention may include other steps and conditions. Except where indicated, aluminum panels measuring 1.5 inches by 2 inches were used in the following examples, and all amounts are percentages by weight.

EXAMPLE 1

This example describes the pre-treatment of the aluminum panels. Prior to contacting the aluminum panels with an aqueous chemical conversion coating solution, the panels were degreased and prepared by sonication in acetone for 30 minutes. They were then cleaned with an alkaline cleaning solution (such as 4215 NCLT available from Elf Atochem—Turco Products Division, Westminister, Calif.), for 10 minutes at 60° C. The panels were then rinsed with deionized water and treated with a deoxidizing solution of 15% LNC deoxidizer (Oakite Products Inc., Berkeley Heights, N.J.) for 10 minutes at 25° C. The panels were then immersed in boiling water for 20 minutes and coated with a thin layer of boehmite of a general formula $AlO_x(OH)_y$.

EXAMPLE 2

This example describes the treatment of the aluminum panels with an aqueous chemical conversion coating solution containing only polymetalate or heteropolymetalate compounds. Aqueous chemical conversion coating solutions of polymetalate or heteropolymetalates having concentrations between about 1.0% and 5.0% were prepared, and the aluminum panels pre-treated as described in Example 1 were immersed in the solution for 2 to 5 minutes at different temperatures ranging from 25° C. to 80° C. The panels were then rinsed thoroughly with deionized water, dried in air for 48 hours and tested by exposure in a salt-fog chamber according to ASTM Method B-117.

EXAMPLE 3

This example describes the treatment of the aluminum panels with conversion coating solutions containing polymetalate or heteropolymetalate compounds in a combination of one or more compounds such as phosphates, borates, silicates, fluorides or metal oxides. Aqueous solutions of polymetalates or heteropolymetalates having concentrations in the range from 1.0% to 5.0% and one or more additives with concentrations from 0.1% to 3.0% were prepared. The aluminum panels prepared as described in Example 1 were immersed in these solutions for 2 to 5 minutes at different temperatures from 25° C. to 80° C. The panels were then rinsed thoroughly with deionized water, dried in air for 48 hours and tested by exposure to a salt-fog chamber in accordance with ASTM Method B-117.

EXAMPLE 4

This example describes the formation of reduced heteropolymolybdates on the substrate surfaces and self-oxidation in air. The panels pre-treated as described in Example 1 were immersed in a conversion coating solution consisting of from 1.0% to 5.0% heteropolymolybdates and from 0.1% to 3.0% fluoride containing species. The panels were left to contact with the conversion coating solution for 2 minutes at temperatures between 60° C. and 80° C. The yellow coating solution (a characteristic color for most of the heteropolymolybdates) turned dark green after 2 minutes and the substrate surfaces were coated with dark films.

It was repeatedly observed that the dark coatings obtained from the treatments of Al 2024-T3 panels with conversion solutions of $H_3PMo_{12}O_{40}$ and $Na_2SiF_6$, became lighter when dried in air for extended periods of time. This was suggestive of the formation of the reduced heteropolymolybdate species during the conversion process and slow reoxidation during the final drying process in air. In order to test this hypothesis, heteropolymolybdate coatings were prepared and handled in an argon atmosphere. This led to the preservation of the coating color. XPS spectra of such a coating was compared with pure heteropolymolybdate compound ($H_3PMo_{12}O_{40}$) as well as with XPS spectra of the same coating dried for 10 days in air (see FIG. 1). As can be seen, the air dried heteropolymolybdate coating shows a set of Mo 3d peaks with a 3d5/2 binding energy at 232.4 eV, which agrees well with that of the pure $H_3PMo_{12}O_{40}$ (232.9 eV, FIG. 1*a*) and is consistent with the presence of six valent molybdenum species. On the other hand, Mo3d XPS spectrum of the argon-dried coatings appeared to be complicated. XPS spectrum shown in FIG. 1*b* reveals at least two sets of Mo 3d peaks at 231.6 eV and 228.1 eV that are suggestive of reduced molybdenum species. These results suggest that reduced heteropolymolybdates are formed during the conversion process and self oxidize in air, forming six valent species that can be further utilized for self-healing of the aluminum surface.

The panels were then rinsed thoroughly with deionized water. During this step, a solution having a blue color (a characteristic color for the reduced heteropolymolybdates) was rinsed off the substrate surfaces. A set of the panels were air dried in a chamber under flowing helium for 12 hours. The dark coating on the panels that was left in air changed to a very light brown color in a few hours. By contrast, when the panels were dried in an inert atmosphere, the dark coating was retained. However, when these dark coatings were exposed to air after 12 hours, the dark color faded away in a few hours due to the oxidation of the reduced heteropolymolybdates.

EXAMPLE 5

This example describes the post-treatment of the coated substrates to enhance and preserve performance of the chemical conversion coating. An aqueous solution of polymetalates or heteropolymetalates having concentrations in the range from 1.0% to 5.0% by weight. The substrate panels prepared as described in Example 1 were immersed in the prepared solutions for two minutes at different temperatures from 50° C. to 80° C. The panels were rinsed thoroughly with deionized water and then received post-treatment by being immersed, first in an aqueous solution containing 0.09% by weight calcium hydroxide and 0.6% by weight lithium nitrate at 100° C. for 20 minutes, and second in an aqueous solution containing 2.4% by weight alkali metal silicate at 80° C. for 5 minutes. They were finally dried in air for 48 hours and tested by exposure to a salt-fog chamber in accordance with ASTM Method B-117.

EXAMPLE 6

This example describes the post-treatment of the coated substrates to enhance and preserve performance of the chemical conversion coating. An aqueous solution of polymetalates or heteropolymetalates having concentrations in the range from 1.0% to 5.0% by weight and one or more additives with concentrations of 0.1% to 3.0% were prepared. The substrate panels prepared as described in Example 1 were immersed in the prepared solutions for two minutes at different temperatures from 50° C. to 80° C. The panels were rinsed thoroughly with deionized water and then received post-treatment by being immersed, first in an aqueous solution containing 0.09% by weight calcium hydroxide and 0.6% by weight lithium nitrate at 100° C. for 20 minutes, and second in an aqueous solution containing 2.4% by weight alkali metal silicate at 80° C. for 5 minutes. They were finally dried in air for 48 hours and tested by exposure to a salt-fog chamber in accordance with ASTM Method B-117.

While the foregoing is directed to the preferred embodiment of the present invention, other and further embodiments of the invention may be devised without departing from the basic scope thereof, and the scope thereof is determined by the claims that follow.

We claim:

1. A method comprising:

oxidizing a metal surface using an aqueous solution of anions in water, wherein the anions comprise one or more heteropolymetalates having the general formula $BM_xO_y^{n-}$, wherein M is a transition metal, B is a heteroatom selected from P, Si, Ce, Mn, Co or mixtures thereof, x is about 1 or greater than 1, y is about 1 or greater the 1, and n− is the valence of the selected anions, and wherein the aqueous solution has a pH of between greater than 2.1 and less than about 5.

2. The method of claim 1, wherein M is selected from Mo, V, or W.

3. The method of claim 1, wherein the concentration of the anions is between about 1% and about 5% by weight.

4. The method of claim 1, wherein the anions are selected from $(PMo_{12}O_{40})^{3-}$, $(PMo_{10}V_2O_{40})^{5-}$, $(MnPW_{11}O_{39})^{5-}$, $(PW_{12}O_{40})^{3-}$, $(SiMo_{12}O_{40})^{4-}$, $(SiW_{12}O_{40})^{4-}$, $(CeMo_{12}O_{42})^{8-}$ or mixtures thereof.

5. The method of claim 1, further comprising:

providing fluoride ions to the aqueous solution, wherein the fluoride ions are provided by a compound selected from ammonium fluoride, alkali metal fluorides, fluorosilicic salts, fluorotitanic salts, fluorozirconic salts or mixtures thereof, wherein the concentration of fluoride ions is between about 0.1% and about 3.0% by weight.

6. The method of claim 1, further comprising:

providing oxyanions to the aqueous solution, wherein the oxyanions are selected from alkali metal permanganate, perrhenate, metavanadate or mixtures thereof, wherein the concentration of oxyanions is between about 0.1% and about 3.0% by weight.

7. The method of claim 1, further comprising:

providing silicate ions to the aqueous solution, wherein the silicate ions are provided by water soluble alkali metal silicate salts, wherein the concentration of silicate ions is between about 0.1% and about 3.0% by weight.

8. The method of claim 1, further comprising:

providing borate ions to the aqueous solution, wherein the borate ions are provided by water soluble alkali metal salts, wherein the concentration of borate ions is between about 0.1% and about 3.0% by weight.

9. The method of claim 8, wherein the alkali metal salts are alkali metal tetraborate.

10. The method of claim 1, further comprising:

providing phosphate ions to the aqueous solution, wherein the phosphate ions are selected from alkali metal orthophosphate, alkali metal metaphosphate, alkali metal pyrophosphate or mixtures thereof, wherein the concentration of phosphate ions is between about 0.1% and about 3.0% by weight.

11. The method of claim 1, further comprising:

providing nitrate ions to the aqueous solution, wherein the nitrate ions are selected from alkali metal nitrates, ammonium nitrates or mixtures thereof, wherein the concentration of nitrate is between about 0.1% and about 1% by weight.

12. The method of claim 1, wherein the metal surface is contacted with the aqueous solution for a time of between about 1 and about 5 minutes.

13. The method of claim 1, wherein the aqueous solution has a temperature between about 25° C. and about 80° C.

14. The method of claim 1, wherein the aqueous solution has a temperature between about 60° C. and about 80° C.

15. The method of claim 1, wherein the aqueous solution has a pH of between about 2 and about 5.

16. The method of claim 1, further comprising:

cleaning the metal surface prior to contacting the metal surface with the aqueous solution.

17. The method of claim 16, wherein the metal surface is selected from aluminum, aluminum alloys and mixtures thereof, and further comprising:

forming a boehmite layer to coat the metal surface by a process selected from boiling or anodizing.

18. The method of claim 1, further comprising:

contacting the oxidized metal surface with a sealing solution containing alkali metal silicate, alkali metal borate, alkali metal phosphate, magnesium hydroxide, calcium hydroxide or barium hydroxide at a concentration of between about 0.015% and about 10%.

19. The method of claim 18, wherein the oxidized metal surface is contacted with the sealing solution for a time between about 1 minute and about 20 minutes, wherein the sealing solution has a temperature of between about 25° C. and about 100° C.

20. The method of claim 1, further comprising:

providing fluoride ions to the aqueous solution, wherein the concentration of fluoride ions is between about 0.1% and about 3.0% by weight.

21. The method of claim 1, further comprising:

providing oxyanions ions to the aqueous solution, wherein the concentration of fluoride ions is between about 0.1% and about 3.0% by weight.

22. The method of claim 1, comprising:

providing borate ions to the aqueous solution, wherein the concentration of fluoride ions is between about 0.1% and about 3.0% by weight.

23. The method of claim 1, further comprising:

providing phosphate ions to the aqueous solution, wherein the concentration of fluoride ions is between about 0.1% and about 3.0% by weight.

24. A method for forming a conversion coating on a metal surface, comprising:

oxidizing the metal surface using an aqueous solution of anions in water, wherein the anions are selected from polymetalates having the general formula $M_xO_y^{n-}$, heteropolymetalates having the general formula $BM_xO_y^{n-}$, or mixtures thereof, and wherein M is a transition metal, B is a heteroatom, x is about 1 or greater than 1, y is about 1 or greater than 1, and n− is the valence of the selected anions; and providing oxyanions to the aqueous solution, wherein the oxyanions are selected from alkali metal permanganate, permanganate, metavanadate or mixtures thereof, wherein the concentration of oxyanions is between about 0.1% and about 3.0% by weight.

25. The method of claim 24, wherein M is selected from P, Si, Ce, Mn, Co or mixtures thereof.

26. The method of claim 24, wherein the concentration of the anions is between about 1% and about 5% by weight.

27. The method of claim 24, wherein the anions are selected from $(PMo_{12}O_{40})^{3-}$, $(PMo_{10}V_2O_{40})^{5-}$, $(MnPW_{11}O_{39})^{5-}$, $(PW_{12}O_{40})^{3-}$, $(SiMo_{12}O_{40})^{4-}$, $(SiW_{12}O_{40})^{4-}$, $(Mo_7O_{24})^{6-}$, $(CeMo_{12}O_{42})^{8-}$ or mixtures thereof.

28. The method of claim 24, further comprising:

providing fluoride ions to the aqueous solution, wherein the fluoride ions are provided by a compound selected from ammonium fluoride, alkali metal fluorides, fluorosilicic salts, fluorotitanic salts, fluorozirconic salts or mixtures thereof, wherein the concentration of fluoride ions is between about 0.1% and about 3.0% by weight.

29. The method of claim 24, comprising:

providing silicate ions to the aqueous solution, wherein the silicate ions are provided by water soluble alkali metal silicate salts, wherein the concentration of silicate ions is between about 0.1% and about 3.0% by weight.

30. The method of claim 24, comprising:

providing borate ions to the aqueous solution, wherein the borate ions are provided by water soluble alkali metal salts, wherein the concentration of borate ions is between about 0.1% and about 3.0% by weight.

31. The method of claim 30, wherein the alkali metal salts are alkali metal tetraborate.

32. The method of claim 24, further comprising:

providing phosphate ions to the aqueous solution, wherein the phosphate ions are selected from alkali metal orthophosphate, alkali metal metaphosphate, alkali metal pyrophosphate or mixtures thereof, wherein the concentration of phosphate ions is between about 0.1% and about 3.0% by weight.

33. The method of claim 24, further comprising:

providing nitrate ions to the aqueous solution, wherein the nitrate ions are selected from alkali metal nitrates, ammonium nitrates or mixtures thereof, wherein the concentration of nitrate is between about 0.1% and about 1% by weight.

34. The method of claim 24, wherein the metal surface is contacted with to aqueous solution for a time of between about 1 and about 5 minutes.

35. The method of claim 24, wherein the aqueous solution has a temperature between about 25° C. and about 80° C.

36. The method of claim 24, wherein the aqueous solution has a temperature between about 60° C. and about 80° C.

37. The method of claim 24, wherein the aqueous solution has a pH of between about 2 and about 5.

38. The method of claim 24, further comprising:

cleaning the metal surface prior to contacting the metal surface with the aqueous solution.

39. The method of claim 38, wherein the metal surface is selected from aluminum, aluminum alloys and mixtures thereof, and further comprising:

forming a boehmite layer to coat the metal surface by a process selected from boiling or anodizing.

40. The method of claim 24 further comprising:

contacting the oxidized metal surface with a sealing solution containing alkali metal silicate, alkali metal borate, alkali metal phosphate, magnesium hydroxide, calcium hydroxide or barium hydroxide at a concentration of between about 0.015% and about 10%.

41. The method of claim 40, wherein the oxidized metal surface is contacted with the sealing solution for a time between about 1 minute and about 20 minutes, wherein the sealing solution has a temperature of between about 25° C. and about 100° C.

42. A method for forming a conversion coating on a metal surface, comprising:

oxidizing the metal surface using an aqueous solution of anions in water, wherein the anions are selected from polymetalates having the general formula $M_xO_y^{n-}$, heteropolymetalates having the general formula $BM_xO_y^{n-}$, or mixtures thereof, and wherein M is a transition metal, B is a heteroatom, x is about 1 or greater than 1, y is about 1 or greater than 1, and n− is the valence of the selected anions; and providing silicate ions to the aqueous solution, wherein the silicate ions are provided by water soluble alkali metal silicate salts, wherein the concentration of silicate ions is between about 0.1% sad about 3.0% by weight.

43. The method of claim 42, wherein M is selected from P, Si, Ce, Mn, Co or mixtures thereof.

44. The method of claim 42, wherein the concentration of the anions is between about 1% and about 5% by weight.

45. The method of claim 42, wherein the anions are selected from $(PMo_{12}O_{40})^{3-}$, $(PMo_{10}V_2O_{40})^{5-}$, $(MnPW_{11}O_{39})^{5-}$, $(PW_{12}O_{40})^{3-}$, $(SiMo_{12}O_{390})^{4-}$, $(SiW_{12}O_{40})^{4-}$, $(Mo_7O_{24})^{6-}$, $(CeMo_{12}O_{42})^{8-}$ or mixtures thereof.

46. The method of claim 42, further comprising:

providing fluoride ions to the aqueous solution, wherein the fluoride ions are provided by a compound selected from ammonium fluoride, alkali metal fluorides, fluorosilicic salts, fluorotitanic salts, fluorozirconic salts or mixtures thereof, wherein the concentration of fluoride ions is between about 0.1% and about 3.0% by weight.

47. The method of claim 42, further comprising:

providing oxyanions to the aqueous solution, wherein the oxyanions are selected from alkali metal permanganate, perrhenate, metavanadate or mixtures thereof, wherein the concentration of oxyanions is between about 0.1% and about 3.0% by weight.

48. The method of claim 42, further comprising:

providing borate ions to the aqueous solution, wherein the borate ions are provided by water soluble alkali metal salts, wherein the concentration of borate ions is between about 0.1% and about 3.0% by weight.

49. The method of claim 48, wherein the alkali metal salts are alkali metal tetraborate.

50. The method of claim 42, further comprising:

providing phosphate ions to the aqueous solution, wherein the phosphate ions are selected from alkali metal orthophosphate, alkali metal metaphosphate, alkali metal pyrophosphate or mixtures thereof, wherein the concentration of phosphate ions is between about 0.1% and about 3.0% by weight.

51. The method of claim 42, further comprising:

providing nitrate ions to the aqueous solution, wherein the nitrate ions are selected from alkali metal nitrates, ammonium nitrates or mixtures thereof, wherein the concentration of nitrate is between about 0.1% and about 1% by weight.

52. The method of claim 42, wherein the metal surface is contacted with the aqueous solution for a time of between about 1 and about 5 minutes.

53. The method of claim 42, wherein the aqueous solution has a temperature between about 25° C. an about 80° C.

54. The method of claim 42, wherein the aqueous solution has a temperature between about 60° C. and about 80° C.

55. The method of claim 42, wherein the aqueous solution has pH of between about 2 and about 5.

56. The method of claim 42, further comprising:

cleaning the metal surface prior to contacting the metal surface with the aqueous solution.

57. The method of claim 56, wherein the metal surface is selected from aluminum, aluminum alloys and mixtures thereof, and further comprising:

forming a boehmite layer to coat the metal surface by a process selected from boiling or anodizing.

58. The method of claim 42, further comprising:

contacting the oxidized metal surface with a scaling solution containing alkali metal silicate, alkali metal borate, alkali metal phosphate, magnesium hydroxide, calcium hydroxide or barium hydroxide at a concentration of between about 0.015% and about 10%.

59. The method of claim 58, wherein the oxidized metal surface is contacted with the sealing solution for a time between about 1 minute and about 20 minutes, wherein the sealing solution has a temperature of between about 25° C. and about 100° C.

* * * * *

UNITED STATES PATENT AND TRADEMARK OFFICE

CERTIFICATE OF CORRECTION

PATENT NO. : 6,863,743 B2
DATED : March 8, 2005
INVENTOR(S) : Zoran Minevski et al.

It is certified that error appears in the above-identified patent and that said Letters Patent is hereby corrected as shown below:

Column 1,
Line 9, insert the following:
-- This invention was made with government support under contract numbers 68-D-98-127 and 68-D-00-203 awarded by the Environmental Protection Agency (EPA). The government has certain rights in this invention. --.

Signed and Sealed this

First Day of November, 2005

JON W. DUDAS
*Director of the United States Patent and Trademark Office*